US008342764B2

(12) United States Patent
Bonneyrat

(10) Patent No.: US 8,342,764 B2
(45) Date of Patent: Jan. 1, 2013

(54) DEVICE FOR PACKAGING AND/OR APPLYING A COSMETIC OR CARE PRODUCT, WITH TRANSLATION DRIVING OF THE PRODUCT

(75) Inventor: Philippe Bonneyrat, Herblay (FR)

(73) Assignee: L'Oreal, Paris (FR)

( * ) Notice: Subject to any disclaimer, the term of this patent is extended or adjusted under 35 U.S.C. 154(b) by 1022 days.

(21) Appl. No.: 12/180,388

(22) Filed: Jul. 25, 2008

(65) Prior Publication Data

US 2009/0028625 A1 Jan. 29, 2009

Related U.S. Application Data

(60) Provisional application No. 60/956,136, filed on Aug. 16, 2007.

(30) Foreign Application Priority Data

Jul. 27, 2007 (FR) ..... 07 56782

(51) Int. Cl.
*B43K 21/00* (2006.01)

(52) U.S. Cl. ..... 401/82; 401/55; 401/63; 401/176; 401/179

(58) Field of Classification Search ..... 401/55–57, 401/63, 65, 82, 171, 176, 179, 75
See application file for complete search history.

(56) References Cited

U.S. PATENT DOCUMENTS

| | | | | |
|---|---|---|---|---|
| 1,675,365 | A | 7/1928 | McAtree | |
| 1,712,840 | A | 5/1929 | Povel | |
| 2,529,037 | A | 11/1950 | Marples | |
| 2,589,000 | A | 3/1952 | Vani | |
| 3,989,392 | A | 11/1976 | Seidler | |
| 4,778,300 | A * | 10/1988 | French et al. | 401/55 |
| 5,167,462 | A | 12/1992 | Lucas | |
| 2008/0095566 | A1 | 4/2008 | Thiebaut et al. | |

FOREIGN PATENT DOCUMENTS

| | | |
|---|---|---|
| CA | 2126764 | 1/1995 |
| EP | 0 504 050 | 9/1992 |
| EP | 0 631 740 | 1/1995 |
| FR | 630743 | 12/1927 |
| GB | 503 290 | 4/1939 |

* cited by examiner

*Primary Examiner* — Tuan N Nguyen
(74) *Attorney, Agent, or Firm* — Oblon, Spivak, McClelland, Maier & Neustadt, L.L.P.

(57) ABSTRACT

A device for packaging and/or applying a cosmetic or care product includes a hollow body forming a housing for the product, a base adapted to support the product and a driving arrangement or means for moving the base in translation so as to vary the volume of the housing. In a disclosed example, the driving arrangement or means includes an actuating member mounted movably in rotation about a shaft and able to be moved along the hollow body that is fixedly attached to the base. The actuating member includes at least one portion forming alternatively a stress surface configured to be put under stress by manual contact and an actuating surface configured to be in engagement along the hollow body.

26 Claims, 7 Drawing Sheets

DEVICE FOR PACKAGING AND/OR APPLYING A COSMETIC OR CARE PRODUCT, WITH TRANSLATION DRIVING OF THE PRODUCT

CROSS-REFERENCE TO RELATED APPLICATIONS

This document claims priority to French Application Number 07 56782, filed on Jul. 27, 2007 and U.S. Provisional Application No. 60/956,136, filed on Aug. 16, 2007, the entire content of which are hereby incorporated by reference.

FIELD OF THE INVENTION

The invention relates to devices for sealed packaging and/or application of a product, particularly of a cosmetic or care product. The device can be particularly advantageous, for example, for products solidified in a stick form.

BACKGROUND OF THE INVENTION

Discussion of Background

"Cosmetic product" means a product as defined in Council Directive 93/35/EEC of 14 Jun. 1993.

In the prior art, document EP 0 504 050 discloses an applicator with a cursor for a solidified product. The applicator comprises a hollow body and a support base for the product. The base is driven in translation by a cursor protruding from the hollow body. Such an applicator has the disadvantage that the user has difficulty in metering the force necessary to make the product emerge or protrude a desired amount. This is particularly inconvenient for products that adhere strongly to the side wall of the hollow body. The user is obliged to apply a high pressure in order to release the stick of product from the side wall. When release occurs, this considerable force causes the product to come virtually right out and it is no longer guided by the side walls and risks falling or dropping. There is a need to better regulate the emergence of the product stick.

U.S. Pat. No. 1,675,365 describes a tube for lipstick fitted with a mechanism for causing the lipstick to protrude. The mechanism comprises a worm in the axis of the exit of the lipstick. An outer thumbwheel rotates the worm in cooperation with a shaft passing through the tube. There is a need to improve the seal of the devices for packaging cosmetic product. Specifically, certain cosmetic products may comprise volatile solvents that evaporate rapidly when they are placed for example on the lips of a user. The lipstick tube described has an insufficient seal to prevent the solvents from evaporating through the clearance between the movable worm and the fixed tube. A dynamic seal between movable parts would be complex to obtain. In addition, such a tube cannot be placed resting on the bottom of the tube because of the presence of the thumbwheel. To have the lipstick emerge more or less, the user holds the tube in one hand and the thumbwheel in the other. However, it is desirable to manoeuvre the outlet of the lipstick with the same hand as that which holds the tube in order to leave the other hand free. This other hand may then be used, for example, to hold a mirror adapted to make the application of product easier.

U.S. Pat. No. 1,712,840 describes a tube for lipstick fitted with another mechanism for protruding the lipstick. The mechanism comprises a gearwheel mounted rotatably on a shaft that is fixed relative to the tube. The gearwheel drives in translation an inner slide fitted with teeth and pushing the lipstick. The shaft for the rotation of the gearwheel passes through the tube. The gearwheel is rotated by a disc placed on one side of the square tube. The manual actuation of the disc is complex, and it can be difficult to hold a tube firmly while pressing on the disc on the side without causing the tube to pivot about its shaft. In addition, the drive disc protrudes from the tube in two directions, both axially in the shaft of the gearwheel and radially in order to be able to be reached by the fingers of the user. It would be preferable to enhance the space requirement and maneuverability of the mechanism for bringing the lipstick out.

Furthermore, U.S. Pat. No. 2,589,000 describes a butter spreader. The spreader comprises a hollow body open on both sides and a follower base pressing the stick of butter towards an opening of the body. A drive wheel is mounted rotatably in the follower base and has a knurled portion with a diameter protruding from the body and small-diameter gear teeth interacting with the teeth of the spreader body. The rotation shaft of the wheel passes through a groove extending along the body and in particular beside the location where the butter is housed before being spread. In particular, the groove accommodating the drive wheel rotation shaft exposes the butter to the outside. Such a spreader is not appropriate for sealingly packaging a cosmetic or care product. In addition, the drive wheel extends over one side of the square tube, so that it is again difficult to manoeuvre the device and the space requirement of such a device is considerable.

U.S. Pat. No. 3,989,392 describes an apparatus for distributing a product in a stick. A body comprises a gearwheel which drives a piston pushing the product. The shaft of the wheel is attached relative to the body. Such a wheel has the disadvantage of not gearing down the thrust force of the piston so that this distributor is not appropriate for a product adhering to the wall of the distributor.

SUMMARY OF THE INVENTION

The invention provides a device for packaging and applying a cosmetic or care product that remedies at least one of the aforementioned disadvantages.

One object of the invention is to provide a device that makes it possible to regulate the emergence of the product while enhancing the maneuverability of the device for protruding or retracting the product.

According to an example of an embodiment, the device for packaging and/or applying a cosmetic or care product comprises a hollow body forming a housing for the product, a base adapted to support the product, and an arrangement or means for driving the base in translation so as to vary the volume of the housing. The driving arrangement or driving means comprise an actuating member mounted movably in rotation about a shaft and able to be moved along the hollow body fixedly attached to the base. The actuating member comprises at least one portion forming alternatively a stress surface configured to be put under stress by manual contact and an actuating surface configured to be in engagement along the hollow body.

In other words, with this example, the same portion of the actuating member comes into contact in turn with the finger of the user then with the hollow body. The effect of this is that the stress surface is facing the hollow body. The user can press the hollow body and the actuating member between the thumb and the rest of the same hand without the device pivoting sideways. By applying a shearing movement between the thumb and the rest of the hand, the user can rotate the actuating member. During the rotation of the member, the portion initially stressed manually moves to engage on an outer face or outer surface of the hollow body and does so on a given height of the hollow body. This has the effect of moving the rotation shaft of the actuating member along the hollow body and of driving the base in translation. The force exerted on the pressure or stress surface is therefore geared down. This makes it possible to regulate the emergence of the product.

According to another example or variation, the hollow body has an inner zone comprising the housing. The base delimits the housing relative to the rest of the inner zone. The shaft of the actuating member extends outside the inner zone. In other words, the rotation shaft of the actuating member may extend exclusively outside the hollow body provided for housing the cosmetic product. Therefore, the rotation shaft of the actuating member is fully offset relative to the hollow body supporting the cosmetic product. The effect of this is that the actuating member can move radially outside the housing of the product in a direction substantially parallel to the axis of extension of the cosmetic product. The actuating member does not extend in the area or region of extension of the product. More generally, the actuating member is not contained in the hollow body. This provides a device with a reduced axial space requirement. The rotation shaft of the drive member is perpendicular to the axis of extension of the product.

By way of example, the base may have a surface in contact with the product extending substantially over the whole cross section of the housing of the product. It is also possible, when the product is sufficiently compact, for the surface of the base in contact with the product not to extend over the whole cross section of the housing, while the translation of the base drives the whole product.

According to another example or variation, the hollow body has a distribution opening adapted to allow the product to pass when the base moves. The opening may be at the end of the housing so that the product can be directly accessed by the user when the base pushes the product out of the housing.

Advantageously, the base can be moved in translation along a sliding axis. The opening may be in alignment with the base in the sliding axis. By way of example, the base may move over a distance of travel forming between 30% and 100% of the length of the housing of the product in the direction of the sliding axis. Preferably, the length of travel may form between 60% and 98% of the length of the housing and in particular between 80% and 95% of this length.

The housing may have an elongated shape along the sliding axis of the case, for example, of a tube of lipstick. The housing may also have a flattened shape having a cross section, perpendicular to the sliding axis that is larger than the thickness of the housing in the sliding axis. This case may be suitable for distributors of products that are not very compact but nevertheless require being pushed in a block.

Advantageously, the base can be moved between a low position furthest from the opening along the sliding axis and a high position closest to the opening. When the base is in the low position, the volume of the housing is at a maximum.

Advantageously, according to a disclosed example, the hollow body comprises a top portion extending between the opening and the base in the low position, with the top portion surrounding the housing and having a continuous inner surface. In other words, the top portion has no orifices other than the opening for distributing the product and the location of the base in the low position. By blocking the distribution opening and the space between the base in the low position and the hollow body, it is possible to keep the product sealed in its housing.

According to another embodiment, the hollow body has an outer surface provided with a rolling track, substantially parallel to the sliding axis of the base and interacting with the actuating surface of the actuating member, when a force is applied to the stress surface of the actuating member.

The force exerted on the stress surface may be a tangential force parallel to the sliding axis. It is also possible to press on the stress surface perpendicular to the sliding axis. This makes it possible to enhance the coupling between the actuating surface and the hollow body.

In an alternate example or variation, the rotation shaft of the actuating member may be at a substantially constant distance from the rolling track, so that the actuating surface interacts constantly with the rolling track. In another example or variation, the actuating member is mounted floatingly so that the actuating surface interacts with the rolling track only when a force is applied to the stress surface.

Advantageously, the rolling track comprises a plurality of reliefs capable of keeping the actuating member stable at various heights of the hollow body. Such reliefs may therefore form a plurality of notches. Such notches each comprise a free edge. These free edges may extend along a common plane parallel to the sliding axis. In other words, each relief can be traversed by a respective plane extending substantially perpendicularly to the sliding axis. For example, the actuating member may be a ball rolling on snap rings or flutes. The pressure on the stress surface is transmitted as pressure of contact between the ball and the snap rings, which increases the force of friction. In such a case, the ball may be suitable for coupling to the snap rings without slowing the rolling of the ball.

According to another embodiment or feature, the actuating member comprises a thumbwheel and the rolling track comprises a rack, with the thumbwheel comprising an actuating surface provided with teeth meshing with the rack. The teeth of the thumbwheel enhance both the driving of the stress surface by a finger and the coupling between the thumbwheel and the rack.

Advantageously, the teeth of the rack can extend in a plane perpendicular to the sliding axis or in a direction perpendicular to the sliding axis.

Advantageously, the teeth of the rack have a length lying, by way of example, between 30% and 70% of the greatest width of the cross section of the hollow body relative to the sliding axis. Having long coupling teeth makes it possible to reduce the depth of these teeth. The radial space requirement of the driving means is reduced without weakening the resistance to wear of the teeth of the thumbwheel or of the rolling track.

Such teeth may extend, for example, over at least 30% of the height of the hollow body and preferably over more than 40% of this height.

According to another example or variation, the rolling track has a concave portion and the actuating member has a matching convex portion or vice-versa. For example, the hollow body may have a section perpendicular to the sliding axis in the shape of a bean. The rolling track is arranged along the concave side of the hollow body and the actuating member has a matching convex shape. The covering surrounding the section of the hollow body and the actuating member may be substantially elliptical. This provides for easy or convenient housing of the assembly in a casing.

In accordance with another example or feature, the hollow body may have an elliptical cross section. The actuating member may rotate about a shaft in the plane of the said cross section and have a shape with a smaller diameter in its mid-portion. This allows a finger to interact more widely with the pressure surface.

According to another embodiment, the driving arrangement or driving means comprise a link arm connecting the actuating member to the base so as to vary the volume of the housing between a maximum volume and a minimum volume. The hollow body has a link opening extending outside the housing of maximum volume and traversed by the link arm. In this embodiment, the fact that the link arm traverses the hollow body outside the housing of maximum volume allows the arm to travel round the housing of maximum volume without traversing it. This allows the housing to have sealed side walls.

According to another example or variation, the link arm has a U shape and comprises an inner branch situated in the inner zone of the hollow body and connected to the base. An outer branch extends parallel to the outside of the hollow body and is connected to the inner branch by a connecting brace situated axially at a distance from the base. With the U shape, the link arm drives the base while travelling round the maximal housing of the product. The free end of the outer branch may be situated substantially at the height of the base. The free end of the outer branch may give an indication of the level of use of the product.

The free end of the link arm may be fitted with the actuating member. The device may be placed flat in the hand. When the thumb is placed on the stress surface of the actuating member, the force is applied substantially in the middle of the device. This enhances the stability of the manoeuvre.

In another example or variation, the outer branch has a substantially flat portion. The hollow body has rails for the guidance in axial translation of the said flat portion. With such guide rails, all the user has to do is pull the free end of the outer branch by the actuating member so that the base follows the same movement.

Advantageously, by way of example, the hollow body can have a tubular shape having a side wall. The link opening comprises a sliding groove arranged in the side wall and allowing the connecting brace to pass.

Advantageously, the groove extends over a height of the hollow body such that it does not come to be facing the product.

Advantageously, the rack extends in the extension of the sliding groove. This makes it possible to increase the engaged length of the teeth. This makes it possible to reduce the space requirement of the driving means.

According to another example or variation, the actuating member is mounted in rotation by two bearing surfaces situated on either side, along the shaft of the actuating member, of the stress surface.

For example, the actuating member may have two side nipples received in two side recesses of the link arm. This makes it possible to balance the traction forces exerted by the link arm.

In another example, the actuating member has two side orifices interacting with two fingers of the link arm.

In yet another example, the actuating member has a symmetrical shape relative to a mid-plane such as a ball, an ovoid, bobbin, barrel or cylinder and in particular straight cylinder shape. The two side bearing surfaces may interact directly with the symmetrical shape.

According to another embodiment, the device comprises a casing provided with a cap that can be closed on a seat. When the cap is closed, the casing has a sealed inner casing space containing the hollow body and the driving arrangement or driving means.

Advantageously, the free end of the outer branch of the link arm protrudes from the seat. The actuating member is mounted free in rotation in the free end. This makes it possible to manipulate the assembly comprising the seat, the hollow body and the driving means and to reclose the cap when the product is returned to its housing.

The product may be in stick form, for example. "Stick" means a product that retains its predetermined shape in the absence of constraint, at ambient temperature and atmospheric pressure. A product packaged in stick form is self-supporting, preferably for at least 60 seconds. Usually, such sticks are obtained by hot-pouring the product or else by extrusion.

Advantageously, the product stick may be a solid compound in particular a dry-crumbleable compound, for example. "Dry-crumbleable" means a compound capable, at ambient temperature, of forming a deposit that adheres and coats on a substrate, particularly of keratinous fibres, and more particularly eyelashes, when they are respectively placed in contact with one another, without requiring prior preparation, and in this instance without requiring previously placing the compound in contact with an aqueous phase. Such dry-crumbleable products differ for example from mascaras in cakes that are water-crumbleable and must first be partially dissolved in order to be applied on the keratinous fibres and form a deposit that adheres and coats.

For example, the stick of product may be a solid compound having a hardness lying between 500 and 18200 Pa, in particular lying between 900 and 10000 Pa, and more particularly between 1800 and 8200 Pa. Such a hardness makes it possible to obtain a compound that is sufficiently rigid to have the shape of a stick while having a sufficiently "soft" structure to allow an easy application on the eyelashes, particularly a deposit of material by placement in contact with the eyelashes without exerting a pressure on the fringe of the eyelashes.

The method used to determine the hardness of a cosmetic compound is the method called the "cheese wire" method. Accordingly, a stick of the compound whose hardness is to be determined is prepared. The stick is obtained by pouring a compound into an aluminium mould placed for 45 minutes at −28° C., then turned out of the mould and packaged in an article of packaging, in particular a pen, and then kept at a temperature of 20° C. for 24 hours prior to the measurement. A rigid wire of 250 μm diameter made of tungsten is brought relative to the stick at a speed of 100 mm/min so as to cut the stick across with the aid of the wire. The measured hardness corresponds to the maximum shearing force exerted by the wire on the stick at 20° C.

Preferably, the hardness of the compounds is such that the compounds are self-supporting and can be easily broken up to form a deposit on the surface of the keratinous fibres when they are brought into contact with them.

However, it is to be understood that the products packaged and applied by the device do not have to be self-supporting. The device may be used to bring a quantity of product to be flush with the opening of the device and to apply to bodily portions other than the eyelashes and the lips.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
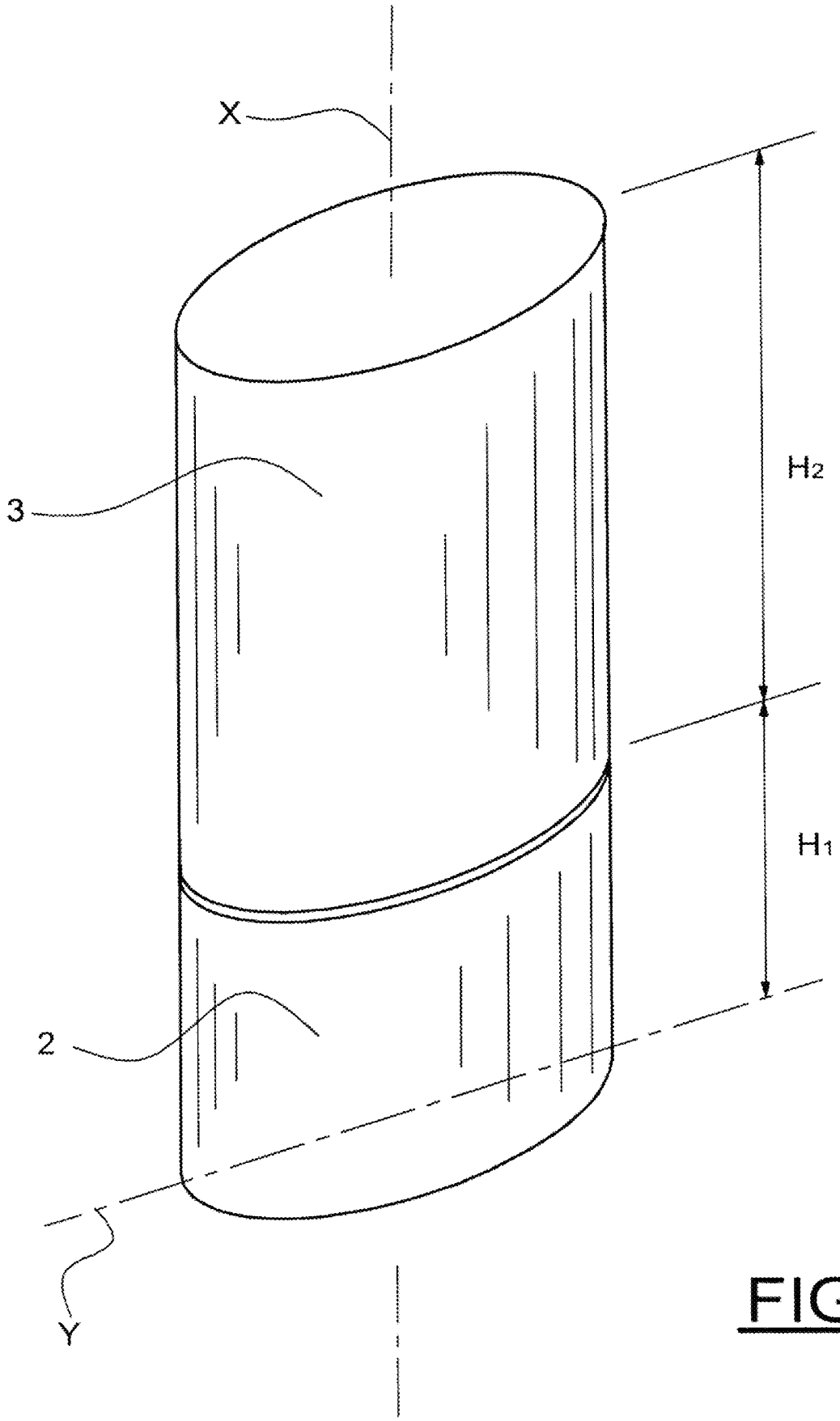
FIG. 1 is an overview of the closed casing.

Referring now to the drawings, like reference numerals are utilized to designate identical or corresponding parts throughout the several views.

In the illustrated example in FIG. 1, the device for packaging and applying a cosmetic or care product comprises a casing 1 comprising a seat 2 on which a cap 3 is mounted. In the illustrated example, the casing 1 has the shape of a cylinder whose generatrix corresponds to an axis of translation X of the cap 3 relative to the seat 2. In particular, a section across the axis X of the casing shows an outward convex contour, for example an ovoid shape and in particular an elliptical cross section with a large or major axis Y that is perpendicular to the axis X.

Along the axis X, in the assembled position, the seat 2 has a height H1 and the cap 3 a height H2. The ratio of the height H1 of the seat 2 over the total of the heights H1 and H2 corresponding to the height of the casing 1 preferably lies between 0.3 and 0.4, for example, and is more preferably of the order of ⅓. Preferably, the height H1 corresponds to the thickness of a thumb, for example. Specifically, the seat 2 is particularly configured to be caught in a squeezing grip between two fingers, for example between the thumb and the index finger. The height H1 is for example between 1 and 3 cm, preferably between 1.5 and 2 cm.

Figure 2:
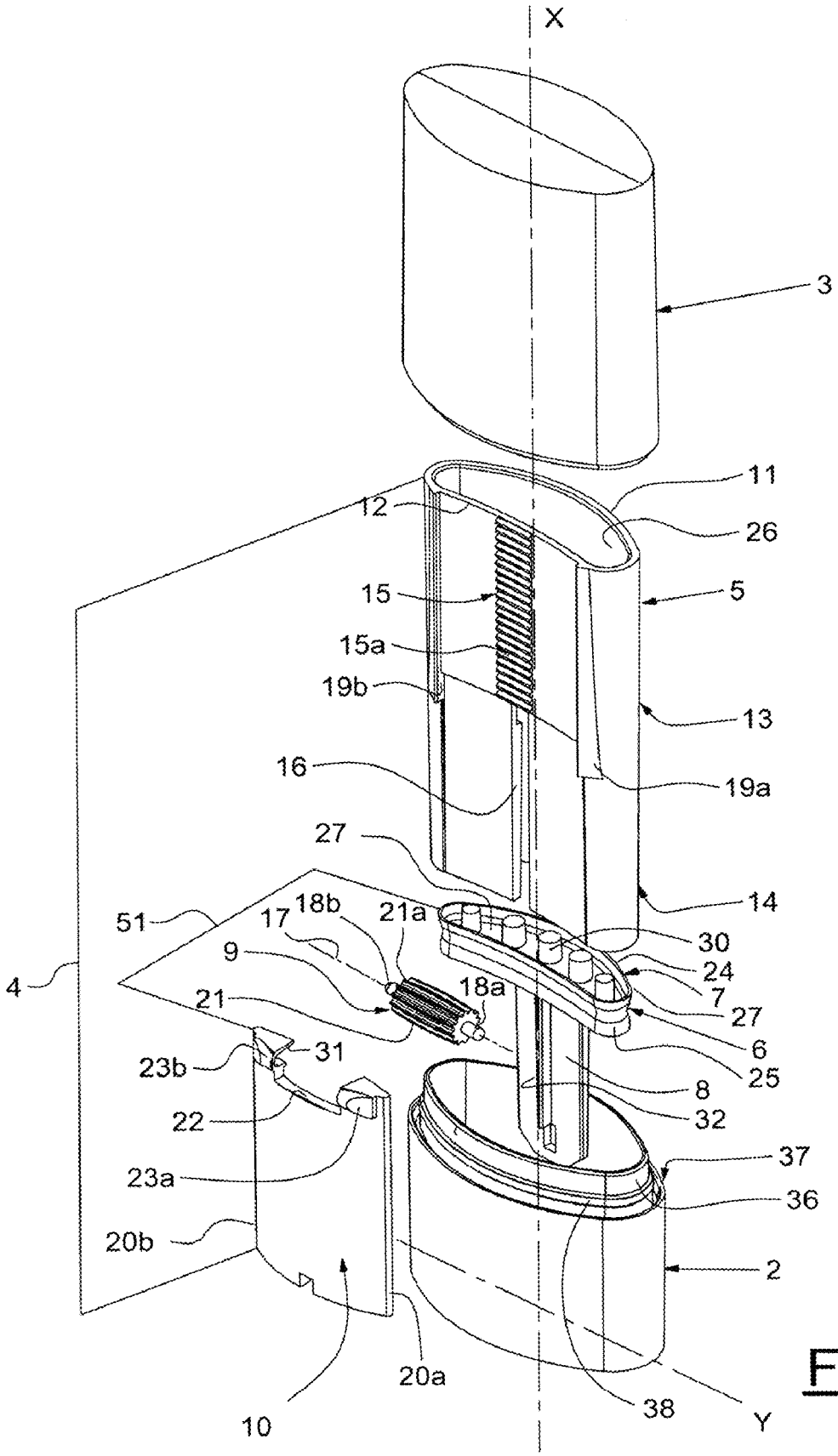
FIG. 2 is an exploded perspective view of a first embodiment or example.

As illustrated in FIG. 2, the casing 1 contains an assembly or means 4 for applying a product 28 that will be illustrated in FIGS. 4 to 8. The casing 1 allows the packaging and distribution of the product 28, particularly of a cosmetic product, being in the form of a stick or grape and extending along the axis X. In this example, the application assembly or means 4 comprises a hollow body 5, a piston 6 that includes a base 7 and a base pedestal 8, a thumbwheel 9, and a guide plate 10.

The hollow body 5 has a cylindrical shape along the axis X and having a bean-shaped cross section, that is to say a cross section elongated along the axis Y. Therefore, this hollow body 5 may have one side or face 11 that is convex and one side or face 12 that is concave. The hollow body 5 has a tubular shape having an opening 50 for the distribution of the product 28, a top portion 13 and a bottom portion 14. The concave side 12 has reliefs on an outer surface in a top portion 13 and in particular a rack 15 and, in a bottom portion 14, a groove 16. The teeth 15*a* of the rack 15 may have a length lying, for example, between 30% and 70% of the greatest width of the cross section of the hollow body relative to the sliding axis. The teeth 15*a* may extend over at least 30% of the height of the hollow body and preferably over more than 40% of this height. The groove may be aligned in the extension of the rack 15 parallel to the axis X situated along the axis Y, substantially in the middle of the concave side 12.

The hollow body 5 has a right side guide rail 19*a* and a left side guide rail 19*b* situated on either side of the rack 15 and parallel to the axis X.

The guide plate 10 has a right side ridge 20*a* and a left side ridge 20*b* adapted to slide respectively in the right guide rail 19*a* and the left guide rail 19*b* parallel to the axis X. The axis X corresponds to the sliding of the piston 6 driving the product 28 and is also called the sliding axis of the base 7.

The thumbwheel 9 is adapted to be mounted in rotation in the top portion of the guide plate 10 along a rotation shaft 17 parallel to the axis Y.

Figure 4:
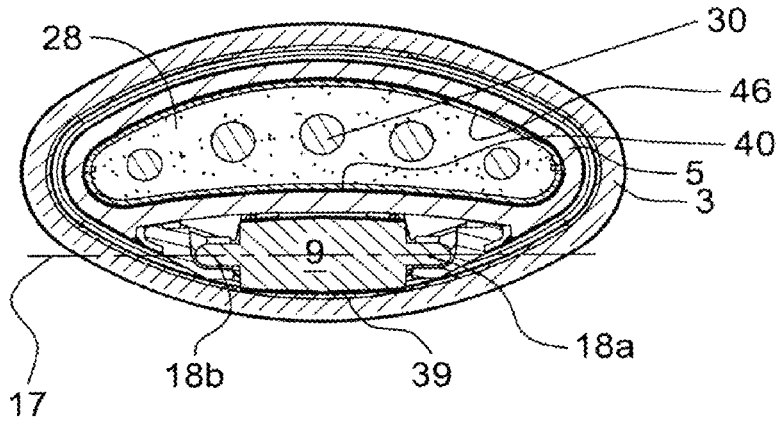
FIG. 4 is a cross section along the plane C-C of FIG. 3.

The thumbwheel 9 is rotatable and comprises a central ovoid portion 21 provided with longitudinal teeth 21*a* substantially parallel to the rotation shaft 17 of the thumbwheel 9. The thumbwheel 9 comprises a right side nipple 18*a* and a left side nipple 18*b* situated on either side of the central portion 21 along the rotation shaft 17. In such an embodiment, the thumbwheel is on a convex portion or surface capable of interacting with an outer concave portion or surface of the hollow body. According to an advantageous feature and as illustrated in FIG. 4, the rotation shaft 17 of the thumbwheel 9 may extend exclusively outside the hollow body 5. In other words, when the device is projected on a plane orthogonal to the sliding axis X, the rotation shaft 17 of the thumbwheel 9 and the hollow body 5 are not superposed.

The top portion of the guide plate 10 has a central recess 22 between a right fastener 23*a* and a left fastener 23*b*. The right fastener 23*a* and left fastener 23*b* each have a bearing 31 in the shape of a U open in a direction perpendicular to the guide plate 10 and adapted to receive the right side nipple 18*a* and left side nipple 18*b* of the thumbwheel 9. As an alternate example or variation, the thumbwheel 9 could be traversed by a rotation shaft mounted on the said right fastener 23*a* and left fastener 23*b*.

When the thumbwheel 9 is attached to the fasteners 23*a*, 23*b*, the central portion 21 of the thumbwheel 9 occupies the central recess 22 of the plate 10 and protrudes on both sides of the guide plate 10. The assembly of the guide plate 10 and the thumbwheel 9 may be inserted into the guide rails 19*a* and 19*b* of the hollow body 5. The teeth 21*a* of the thumbwheel 9 interact with the rack 15 via an actuating surface 40 of the thumbwheel 9. The thumbwheel has a stress surface 39, opposite to the actuating surface 40, and protruding from the guide plate 10 so that a finger sliding along the guide plate 10 can press on the pressure surface 39 to rotate the thumbwheel 9.

The hollow body 5 is of tubular shape and has an inner zone 45 extending along the axis X and emerging at the top end of the hollow body 5 through an opening 50 designed for the distribution of the product 28.

The hollow body 5 has an inner zone 45 comprising the housing 46, the base 7 delimiting the housing 46 relative to the rest of the inner zone, and with the shaft 17 of the actuating member extending outside the inner zone 45.

The base 7 has a flexible top sealing lip 24 and a flexible bottom guide lip 25 both extending over the periphery of the base 7 and adapted to closely hug an inner surface 26 of the inner zone 45. The base 7 has a top side 27 adapted to receive the product 28. The top side 27 has a cup shape delimited by the top lip 24, a flat bottom 29 and a series of mooring nipples 30 protruding from the flat bottom 29 to the product 28.

The portion of the inner zone situated above the base 7 of the piston 6 forms a housing 46 of the product 28. The volume of the housing 46 varies with the position of the piston 6 in the inner zone 45.

The base foot 8 extends on the side opposite to the top side 27, parallel to the guide plate 10 and has a reinforcing rib 32.

Figure 3:
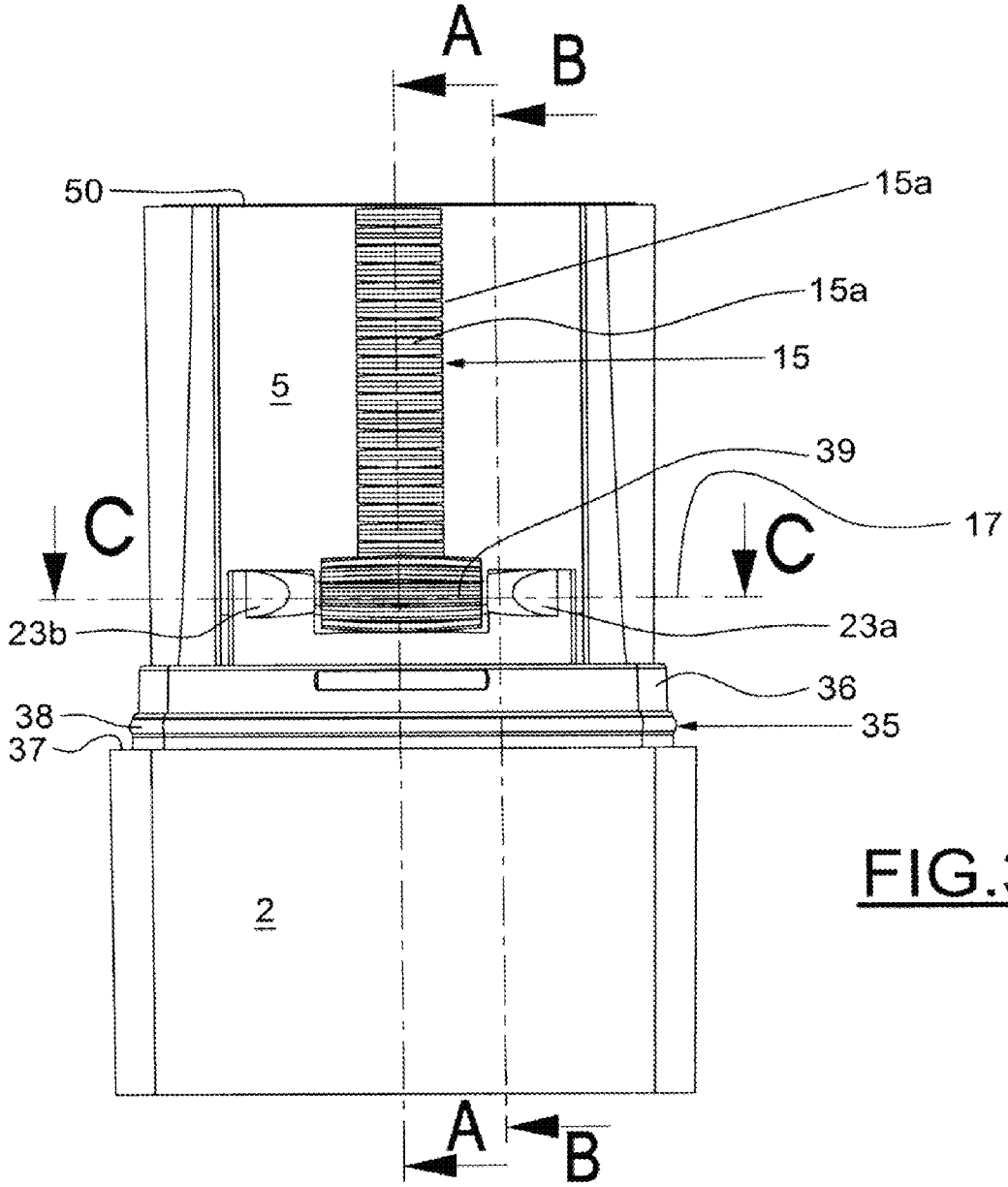
FIG. 3 is a side view of the first embodiment.

As illustrated in FIG. 3, the application assembly or means 4 are introduced into the seat 2. The seat 2 has means 35 for snap-fitting the cap 3 comprising a skirt 36 protruding from a shoulder 37 and extending over an inner periphery of the seat 2. In the illustrated example, a snap-fitting flange 38 extends all around the skirt 36 parallel to the shoulder 37.

The application means 4 are shown in the low position in FIG. 3. The rotation shaft 17 of the thumbwheel 9 is substantially in the middle of the hollow body 5. In the low position, the thumbwheel 9 is situated above the skirt 36 of the seat 2. In this embodiment, the stress surface 39 of the thumbwheel 9 extends over a width that is greater than that of the rack 15. Therefore, the finger of the user drives the teeth 21*a* of the thumbwheel 9 over the whole length of the thumbwheel. Only the central portion of the teeth 21*a* of the thumbwheel 9 serves as an actuating surface 40 interacting with the teeth 15*a* of the rack 15.

As illustrated in FIG. 4, the product 28 occupies the housing 46 in the top portion 13 of the hollow body 5. The central ovoid portion 21 of the thumbwheel 9 protrudes radially from the guide plate 10 without however radially protruding from the skirt 36 so that the cap 3 adjusted to the skirt 36 surrounds all the application means 4 and has an elliptical inner and outer profile.

Figure 5:
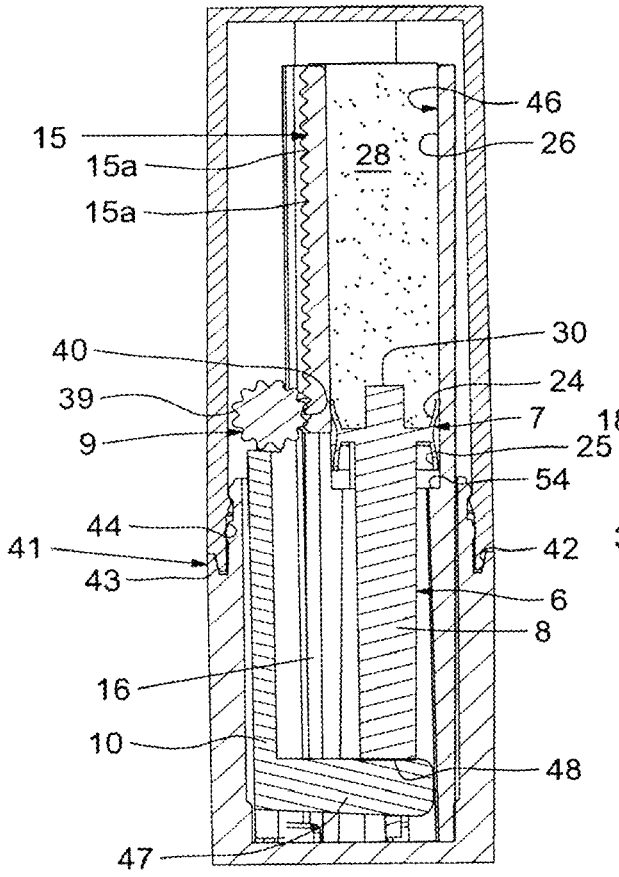
FIG. 5 is a longitudinal section along the plane A-A of FIG. 3.
Figure 6:
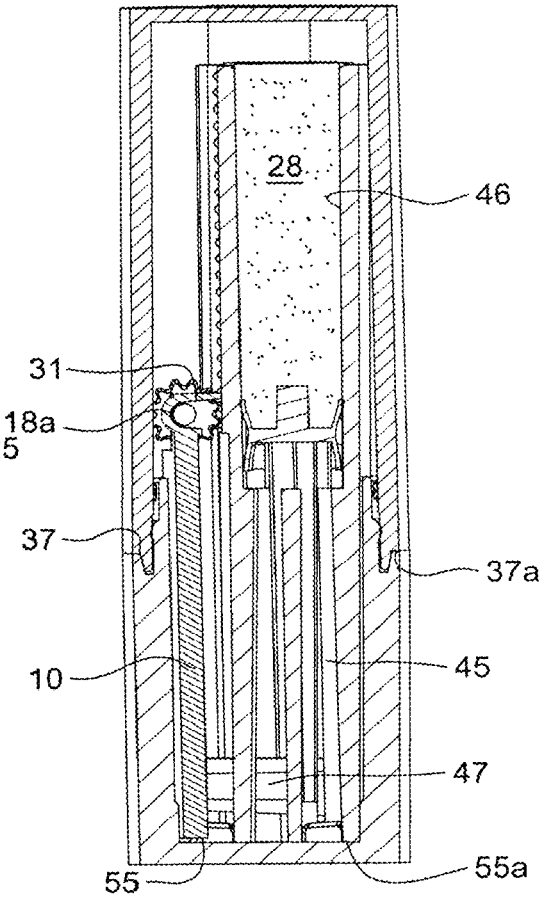
FIG. 6 is a longitudinal section along the plane B-B of FIG. 3.

As illustrated in FIGS. 5 and 6, the casing 1 comprises means 41 for sealing between the seat 2 and the cap 3. The shoulder 37 of the seat 2 has a circular groove 42 extending to the foot of the skirt 36. The lower rim of the cap 3 has an inner lip 43 adapted to penetrate by force into the circular groove 42. The cap 3 has an inner flange 44 adapted to interact with the snap-fitting flange 38 of the seat 2. The elastic deformation of the cap 3 allows the flange 44 to expand around the snap-fitting flange 38 and to move axially past the said flange 38 so that a shoulder 37*a* of the cap 3 is pressed against the shoulder 37 of the seat 2.

The inner zone 45 has an inner shoulder 54. The portion of the inner zone 45 corresponding to the bottom portion 14 of the hollow body 5 has a smaller cross section than the base 7.

A drive lug 47 extends perpendicularly to the guide plate 10 and forms with the guide plate 10 a one-piece assembly. The drive lug 47 traverses the groove 16 and an orifice 48 of the base foot 8. The drive lug 47 constitutes a connecting brace 49 between the guide plate 10 and the base foot 8 that are substantially parallel. The assembly comprising the thumbwheel 9, the guide plate 10 and the piston 6 forms an arrangement or means 51 for driving the product 28.

The method of assembling the device will now be described. The piston 6 is inserted into the opening 50 beginning with the base foot 8, until the lower lip 25 of the base 7 is resting on the inner shoulder 54 of the hollow body 5. The piston 6 then occupies an extreme assembly position which is lower than the low position of normal operation of the device. The thumbwheel 9 and the guide plate 10 are assembled and the drive lug 47 is placed opposite the orifice 48 of the base foot. In this extreme assembly position, the ridges 20*a* and 20*b* of the guide plate 10 are not yet inserted into the guide rails 19*a* and 19*b* of the hollow body 5.

The driving arrangement or driving means 51 is then moved from the extreme assembly position to the low operating position. In this low operating position, the thumbwheel 9 is engaged with the beginning of the rack 5 and the ridges 20*a* and 20*b* are inserted into the guide rails 19*a* and 19*b*. The bottom end 55 of the guide plate 10 is flush with the bottom end 55*a* of the hollow body 5.

The driving arrangement or driving means 51 and the hollow body 5 are then inserted into the seat 2. The product 28 may be inserted into the device by hot pouring when the driving means 51 is in the low position. The seat 2 prevents the bottom end 55 of the guide plate 10 from descending lower and maintains the cohesion of the driving means 51.

Figure 7:
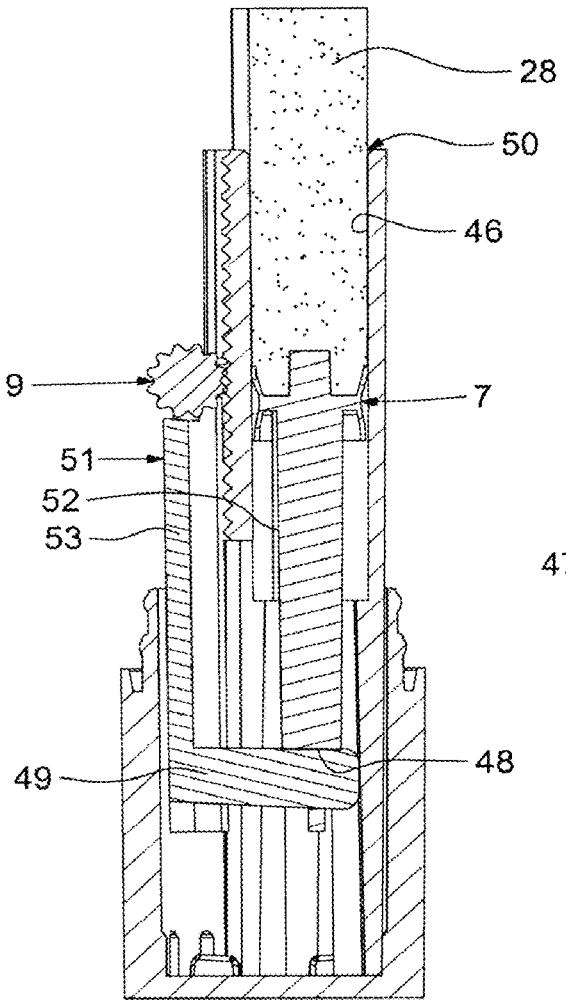
FIG. 7 is a section along the plane A-A of FIG. 3 of the device in the intermediate position.
Figure 8:
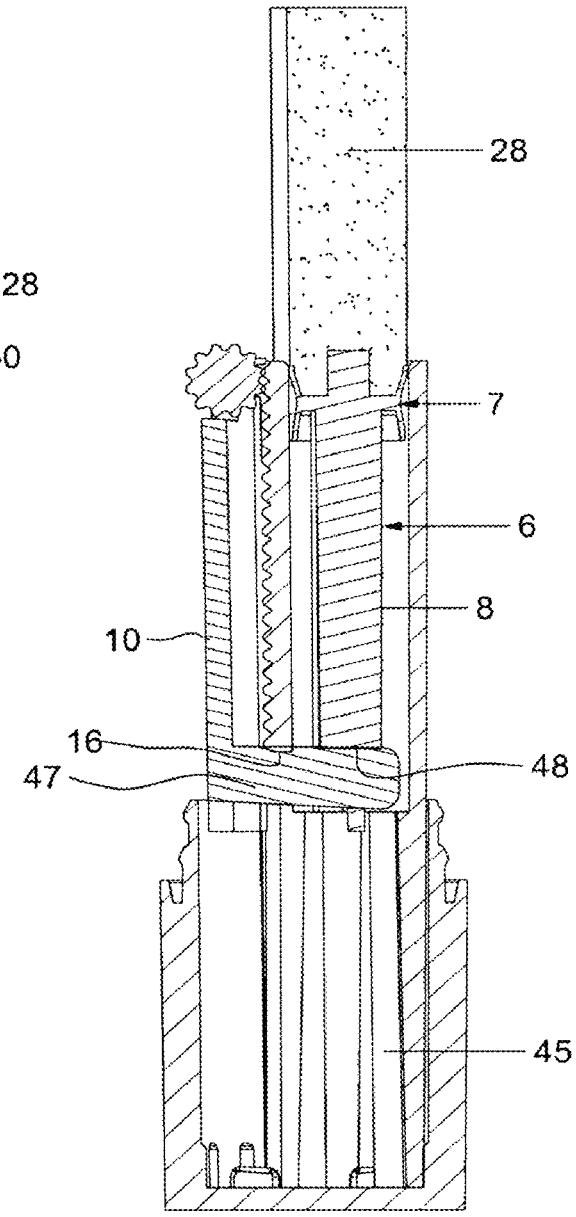
FIG. 8 is a section along the plane A-A of FIG. 3 of the device in the fully out or fully protruded position.

The operation of the device will now be described with the aid of FIGS. 7 and 8. The driving means 51 has a U shape in which the base foot 8 forms an inner branch 52, the guide plate 10 forms an outer branch 53 and the connecting brace 49 forms the base of the U shape. The top portion of the guide plate 10 forms the free end of the outer branch 53. When the operator slides his/her thumb over the stress surface 39 of the thumbwheel 9, the latter rolls on the rack 15 provided on the outer surface of the hollow body 5. A portion of the thumbwheel 9 is successively, or in turn, actuated by the operator's thumb, then meshes with the rack 15. The side nipples 18*a* and 18*b* of the thumbwheel 9 pull the fasteners 23*a* and 23*b* of the guide plate 10. Therefore, the assembly of the driving means 51 and the product 28 is moved en bloc. In other words, the rotation of the thumbwheel 9 drives its movement along an outer face of the hollow body 5 over a given height. This movement causes the fixedly attached movement of the base 7. Such a movement may take place in the direction of the opening 50 for distribution of the product 28 in order to extract from the hollow body 5 a quantity of product 28 to be applied or away from the said opening 50 in order to retract the said product 28 into the hollow body 5. The base 7 may move in sealed sliding contact against the inner wall of the hollow body 5. The thumbwheel 9 allows for the tangential driving force of the stress or pressure surface 39 to be half as much as the force necessary to drive the driving means 51 of the product 28.

When the top lips 24 are flush with the distribution opening 50, the thumbwheel 9 arrives at the top end of the rack 15 and the drive lug 47 comes to abut the bottom of the groove 16. This position is the highest possible operating position of the device.

Figure 9:
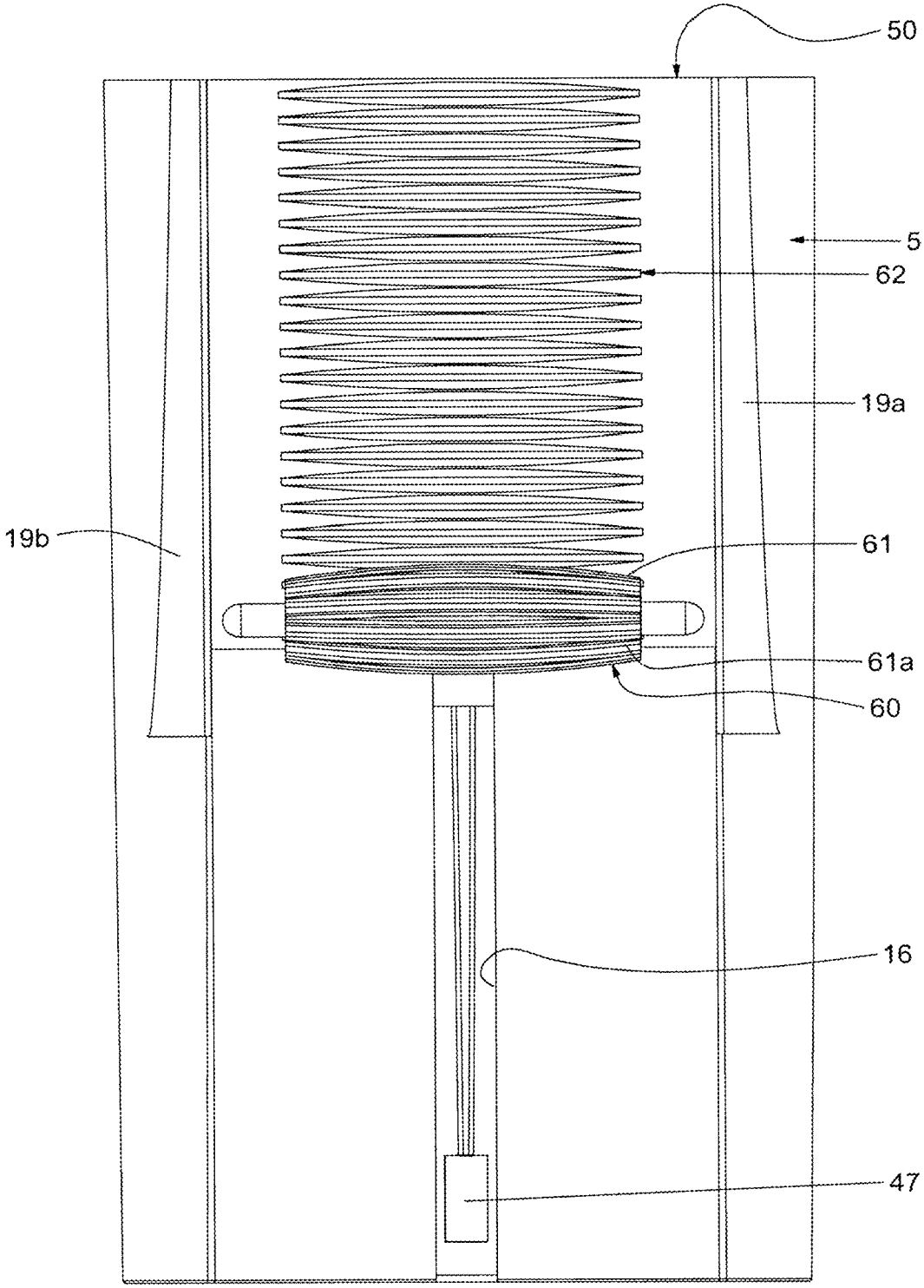
FIG. 9 is a side view of the hollow body and of the thumbwheel of a second embodiment.

The second example of an embodiment illustrated in FIG. 9, in which identical elements carry the same reference numbers, comprises a thumbwheel 60 comprising a central portion 61 that is longer than in the previous embodiment and a rack 62 as wide as the length of the teeth 61*a* of the thumbwheel 60. All the other features of the embodiment previously described also exist in this second embodiment. In particular, the central portion 61 of the thumbwheel 60 has a sufficiently rounded longitudinal section for the cap 2 to be able to surround the hollow body 5 and all the driving arrangement or driving means 51 while having a harmonious shape.

Figure 10:
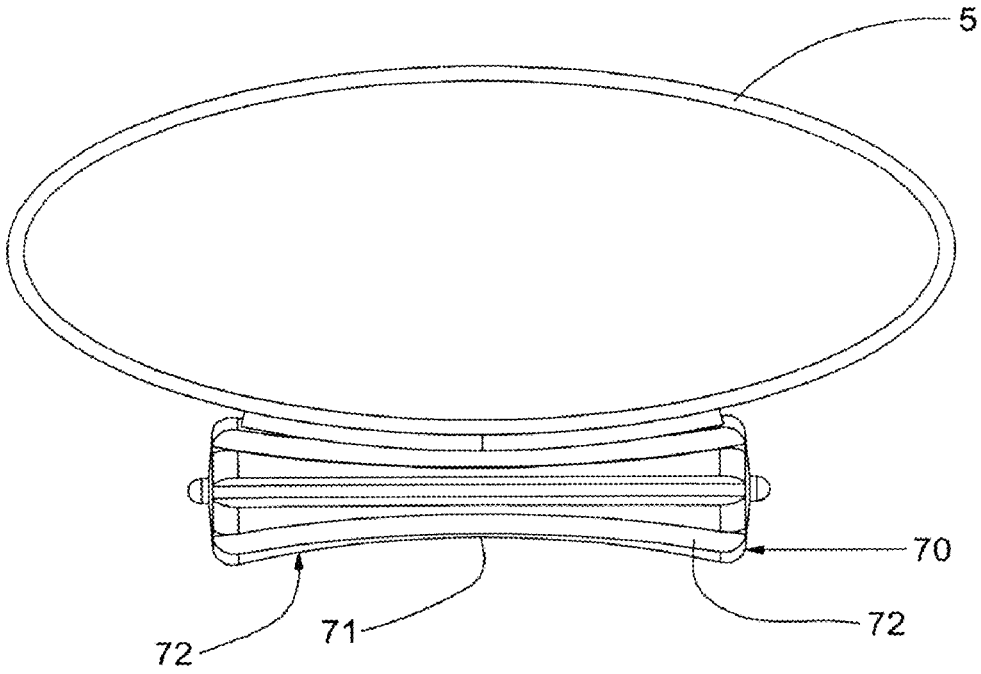
FIG. 10 is a top view of the hollow body and of the thumbwheel of a third embodiment.

As illustrated in FIG. 10, the third example of an embodiment comprises a thumbwheel 70 capable of interacting with a convex rack. The thumbwheel 10 has a central diameter 71 smaller than the side diameters 72 so that the thumbwheel 70 has a better grip on the thumb of an operator. Such a thumbwheel is generally bobbin-shaped.

In this embodiment, a concave portion or face of the thumbwheel engages with a convex matching portion or face of the hollow body.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and/or applying a cosmetic or care product comprising:

a hollow body having an inner surface comprising a housing for the product which extends along an axis;

a base adapted to support the product in said housing; said base delimiting the housing relative to the rest of the inner surface, means for driving the base in translation so as to vary the volume of the housing, said driving means comprising an actuating member which is rotatably mounted on a shaft and which moves along the hollow body, wherein said actuating member is fixedly attached to the base, wherein said actuating member comprises at least one portion forming alternatively a stress surface configured to be put under stress by manual contact and an actuating surface configured to be in engagement along the hollow body, wherein the shaft of the actuating member is radially offset relative to the inner surface and to the hollow body such that said actuating member can move outside said inner surface and said hollow body, and wherein the actuating surface of the actuating member engages and moves along an outer surface of the hollow body, which is radially opposite to the inner surface and oriented radially outwards.

2. A device according to claim 1, wherein the inner surface of the hollow body includes the housing, and the base delimits the housing relative to the rest of the inner surface, and wherein the shaft of the actuating member is positioned outside of the inner surface.

3. A device according to claim 1, wherein the hollow body has a delivery opening through which the product passes when the base moves.

4. A device according to claim 1, wherein the base is movable to translate along a sliding axis.

5. A device according to claim 4, wherein the hollow body includes an opening through which the product passes when the base moves, and wherein the base is movable between a low position furthest from the opening along the sliding axis, and a high position closest to the opening.

6. A device according to claim 5, wherein the hollow body comprises a top portion extending between the opening and the base in the low position, wherein the top portion surrounds the housing and includes a continuous inner surface.

7. A device according to claim 4, wherein the hollow body has an outer surface provided with a rolling track which is substantially parallel to the sliding axis of the base and which interacts with the actuating surface of the actuating member when a force is applied to the stress surface of the actuating member.

8. A device according to claim 7, wherein the rolling track comprises a plurality of reliefs which keeps the actuating member stable at various heights of the hollow body.

9. A device according to claim 8, wherein the actuating member comprises a thumbwheel and the rolling track comprises a rack, and wherein the thumbwheel comprising the stress surface includes teeth meshing with the rack.

10. A device according to claim 9, wherein the rack includes teeth which extend in a direction perpendicular to the sliding axis.

11. A device according to claim 9, wherein the teeth of the rack have a length lying between 30% and 70% of the greatest width of a cross section of the hollow body relative to the sliding axis.

12. A device according to claim 7, wherein the rolling track has a concave portion and the actuating member has a matching convex portion or vice-versa.

13. A device according to claim 1, wherein the driving means comprise a link arm connecting the actuating member to the base so as to vary the volume of the housing between a maximum volume and a minimum volume, and wherein the hollow body includes a link opening extending outside the housing when the housing has the maximum volume, and the link of the hollow body is traversed by the link arm.

14. A device according to claim 13, wherein the link arm has a U shape and comprises an inner branch situated in the inner surface of the hollow body and connected to the base, and an outer branch extending parallel to an outside of the hollow body and connected to the inner branch by a connecting brace, and wherein the connecting brace is positioned axially at a distance from the base.

15. A device according to claim 14, wherein the outer branch has a substantially flat portion, and wherein the hollow body has rails which axially guide the flat portion.

16. A device according to claim 14, wherein the hollow body has a tubular shape having a side wall, and wherein the link opening comprises a sliding groove arranged in the side wall through which the connecting brace passes.

17. A device according to claim 16, wherein the sliding groove extends along a height of the hollow body which does not face the product throughout movement of the base from a lowermost position to an uppermost position.

18. A device according to claim 16 wherein the actuating member includes a thumbwheel which engages a rack on the hollow body, and wherein the rack extends along an extension aligned with the sliding groove.

19. A device according to claim 1, wherein the actuating member is rotatably mounted in two bearing surfaces situated on either side, along the shaft of the actuating member, of the stress surface.

20. A device according to claim 1, comprising a casing provided with a cap that can be closed on a seat, the casing having, when the cap is closed, a sealed inner casing space, containing the hollow body and the driving means.

21. A device according to claim 20, wherein the driving means includes a link arm having a U shape, said link arm including an inner branch inside of the hollow body, an outer branch outside of the hollow body, and a connecting branch extending between the inner and outer branches, and wherein a free end of the outer branch of the link arm protrudes from the seat, and the actuating member is rotatably mounted on said free end.

22. A device according to claim 1, further including a seat, wherein said hollow body is fixed relative to said seat, and wherein said means for driving is at least partially housed within said seat, and further wherein at least a portion of said means for driving progressively emerges from said seat as said actuating member moves along said hollow body to feed the product out of the hollow body.

23. A device according to claim 22, wherein the means for driving includes a guide plate which progressively emerges from the seat as the actuating member moves along the hollow body, and wherein the guide plate is guided by at least one rail provided on the hollow body, and further wherein the actuating member is rotatably mounted on the guide plate.

24. A device for packaging and/or applying a cosmetic or care product comprising:

(a) a hollow body having an inner surface comprising a housing for the product which extends along an axis, said hollow body including an opening;

(b) a base which supports said product in said housing and which delimits the housing relative to the rest of the inner surface, the base being movable relative to said hollow body;

(c) a drive arrangement which moves said base relative to said hollow body in order to feed the product through the hollow body and out of said opening, said drive arrangement including:

(i) a rotatable actuator member which engages said hollow body such that upon rotation of said rotatable actuator member said rotatable actuator member travels along an outer surface of said hollow body in a lengthwise direction of said hollow body, and wherein at least a portion of said actuator member is exposed to outside of said device for a user to engage said portion and rotate said rotatable actuator member; and (ii) at least one link coupling said rotatable actuator member to said base such that said base moves relative to said hollow member as said rotatable actuator member travels along said hollow body; and (d) a seat which houses at least a portion of said driving means and wherein said hollow body is fixed relative to said seat, wherein a shaft of the actuator member is radially offset relative to the inner surface and to the hollow body such that the actuator member can move outside said inner surface and said hollow body, and wherein the actuating surface of the actuator member engages and moves along an outer surface of the hollow body, which is radially opposite to the inner surface and oriented radially outwards.

25. A device according to claim 24, wherein said at least one link includes a guide plate which is at least partially housed in said seat, and wherein said rotatable actuator member is rotatably mounted on said guide plate; and wherein as said rotatable actuator member travels along said hollow body to feed the product through the opening of said hollow member, the guide plate is progressively moved out of the seat and an amount the guide plate projects from the seat progressively increases.

26. A device according to claim 25, wherein said guide plate is guided by at least one rail provided on said hollow body, and wherein the device further includes a cap which is selectively mountable on said seat, and wherein when said cap is in a mounted position on said seat said cap covers said hollow body.

* * * * *